United States Patent [19]

Otenbaker

[11] Patent Number: 4,982,580

[45] Date of Patent: Jan. 8, 1991

[54] CONVERTIBLE ARTICLE OF JEWELRY

[76] Inventor: Audrey L. Otenbaker, 33758 King Richard, Sterling Heights, Mich. 48310

[21] Appl. No.: 390,727

[22] Filed: Aug. 8, 1989

[51] Int. Cl.[5] ..... A44C 25/00

[52] U.S. Cl. ..... 63/2; 63/20; 63/29.1

[58] Field of Search ..... 63/2–20, 63/23, 29.1, 31, DIG. 3; 428/7, 14, 71; 40/1.6, 1.5, 586, 622, 639, 640, 657

[56] References Cited

U.S. PATENT DOCUMENTS

| | | | |
|---|---|---|---|
| 127,353 | 5/1872 | Knipfer . | |
| 235,652 | 12/1880 | Ross | 63/20 X |
| 292,810 | 2/1884 | Hartmann . | |
| 330,230 | 11/1885 | Hafner . | |
| 971,181 | 9/1910 | Dover . | |
| 1,006,506 | 10/1911 | Spaney et al. . | |
| 1,513,237 | 10/1924 | Green . | |
| 2,096,389 | 10/1937 | Bode . | |
| 2,568,513 | 9/1951 | Rossein | 40/622 |
| 3,088,295 | 5/1963 | Haines . | |
| 3,605,438 | 9/1971 | Chalson . | |
| 3,805,549 | 4/1974 | Nielsen | 63/29.1 X |
| 3,839,821 | 10/1974 | Forsman . | |
| 3,898,868 | 8/1975 | Tomlinson . | |
| 3,968,661 | 7/1976 | Williams . | |
| 4,400,932 | 8/1983 | Epstein . | |
| 4,507,844 | 3/1985 | Baughman . | |
| 4,655,054 | 4/1987 | Roesch . | |

FOREIGN PATENT DOCUMENTS

| | | | |
|---|---|---|---|
| 448340 | 1/1913 | France | 63/20 |
| 406711 | 8/1966 | Switzerland | 63/20 |
| 538528 | 8/1941 | United Kingdom | 63/20 |

*Primary Examiner*—Laurie K. Cranmer
*Attorney, Agent, or Firm*—Harness, Dickey & Pierce

[57] ABSTRACT

A convertible article of jewelry which has a base member which is capable of securely holding a number of studded ornaments arranged in varying fashions by the user thereof. The article has an attachment element so that it may be worn on clothing or as a necklace pendant. Also disclosed is an interchangeable decorative veil with an optional rim.

16 Claims, 1 Drawing Sheet

CONVERTIBLE ARTICLE OF JEWELRY

TECHNICAL FIELD

The present invention generally relates to jewelry and, more particularly, is concerned with an article of jewelry which is convertible in that the wearer may vary the number and arrangement of studded ornaments on the article.

BACKGROUND OF THE INVENTION

Historically, men and women have nearly always worn jewelry of some variety. Usually the ornaments worn as jewelry are used as one particular type of jewelry piece. Three examples are earrings, tie pins, and fraternity/sorority pins. Outside of their intended purpose these items of jewelry are seldom, if ever, used for anything else.

Oftentimes the clasp portion of a tie pin or a fraternity/sorority pin will become lost. One earring may become lost rendering the other one useless. Another common problem is that less expensive pierced earrings may irritate sensitive ears and can no longer be worn.

One of the more appealing features of jewelry in general is that a person can choose to wear a particular item of jewelry on any given occasion. But the wearer has had very little direct input into the design and overall appearance of jewelry on the market today. Therefore, to have the right jewelry for any particular occasion requires a person to own many items of jewelry, which can be very expensive.

SUMMARY OF THE INVENTION

A principal objective of the invention is to provide varying arrangements of ornamental jewelry which can be determined by the user and displayed as a unique piece of jewelry. In this regard, the invention is constructed to permit the arrangement to be varied by the user within seconds to go with almost any outfit. In one form of the present invention, a pin arrangement is provided which can be worn on a dress, blouse, sweater, jacket, coat or other garment. The invention could also be worn as a pendant on a necklace.

Another objective of the invention is to provide a new way of using otherwise useless jewelry. Jewelry having missing pieces such as tie pins, fraternity/-sorority pins and pierced earrings are some of the studded ornaments which may now be used on this self-designed article of jewelry. The invention is susceptable to relatively inexpensive embodiments and may incorporate previously purchased jewelry or newly purchased jewelry. Many exciting, self-designed arrangements could be made using this invention.

To achieve the foregoing objectives, the present invention provides a convertible article of jewelry which includes a base member capable of securely holding a user defined arrangement of studded ornaments, and a suspension device for permitting the article of jewelry to be worn by the user.

DESCRIPTION OF THE PREFERRED EMBODIMENTS

Figure 1:
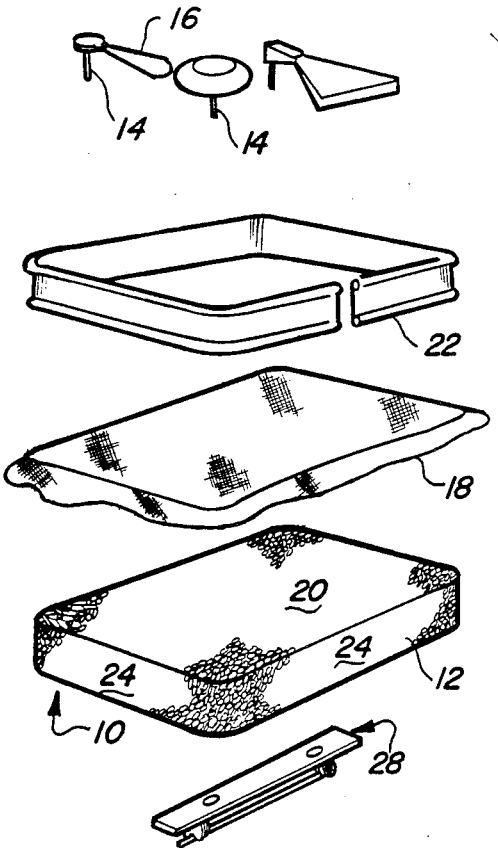
FIG. 1 is an exploded assembly view of one embodiment of the invention.

Referring to FIG. 1, an article of jewelry 10, according to the present invention, is shown in its unassembled condition. The article 10 includes a base member 12 which may be made of cork or other relatively light, penetrable material. While the base member 12 could be constructed from a substantially rigid material, relatively elastic materials such as foamed rubber or plastic could also be used in the appropriate application. The base member 12 should be thick enough to totally conceal the studs 14 of the studded ornaments 16. In this way, the base member 12 will support the studded ornaments 16, without any need to have a back clip attached to the studded ornaments. The ornaments 16 are inserted into the base member 12 in any arrangement desired by the user. The studded ornaments 16 can be removed and replaced by other studded ornaments 16 (in the same or different location) to provide an article of jewelry which will suit any particular outfit. The studded ornaments 16 may be pierced earrings, fraternity/sorority pins, tie pins, or any other studded ornamental element. The base member 12 can be made in any particular shape or size and can be generally flat or could have a raised surface.

A veil 18 may be used to decoratively cover the surface of the base member 12. In this regard, the veil 18 will conceal the holes which may be created in the base member surface from previous arrangements of ornamental elements 16. The veil 18 could be fabric of various textures and colors or any other suitable material. The veil 18 may be draped or overlayed across a front surface 20 of the base member 12 and held in place by a rim 22. The rim 22 fits over the veil 18 and the perimeter 24 of the base member 12 and may be held in place by a friction fit or other attachment means such as pins, clips and so forth. The rim 22 may be made of a lightweight metal such as aluminum or it could be made of elastic or other suitable material and can be plated, painted, stitched or have any other suitable finish. The veil 18 could be stapled, glued or otherwise tacked to a back surface (not shown) of the base member 12 and the rim 22 would not be needed in the appropriate application.

Figure 2:
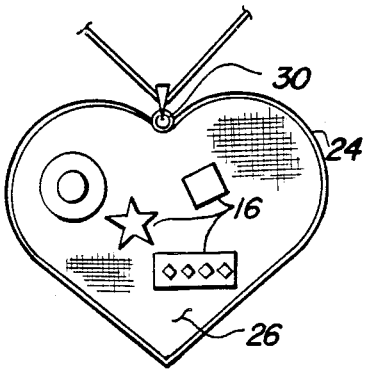
FIG. 2 illustrates another embodiment of the invention constructed to be used as a necklace pendant.
Figure 3:
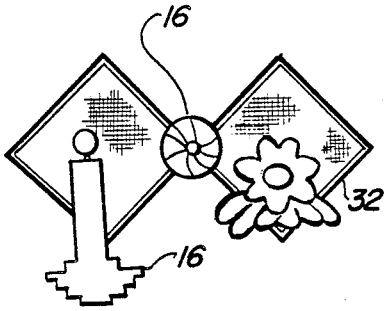
FIG. 3 illustrates another embodiment of the invention showing a different shape for the base member.
Figure 4:
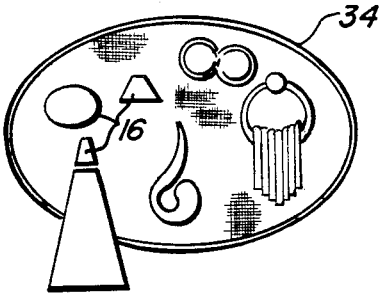
FIG. 4 illustrates another embodiment of the invention showing yet another shape for the base member.

In order to wear the invention the base member 12 in a preferred embodiment includes means for suspending the article 10 on the user. The suspension means could be a pin assembly 28 permanently affixed to the back surface (not shown) of the base member 12 which would enable the article to be removably attached to a piece of clothing. Another embodiment incorporates a chain loop 30 securely attached to the perimeter 24 of a base member 26 for wearing the article as a necklace pendant as shown in FIG. 2. FIGS. 3 and 4 show some other embodiments in which the shape of the base members 32, 34 are varied.

Any arrangement using a number of studded ornaments 16 can be incorporated by the user to design his/her own unique article of jewelry on any suitably shaped base member 12. Since the studded ornaments 16 can be removed from the base member 12 with relative ease and convenience, and since the decorative veil 18 can also be easily removed in a preferred embodiment of this invention, the user essentially has an abundant source for new and unique displays.

It is thought that the article of jewelry of the present invention and its attendant advantages will be understood from the foregoing description and it will be apparent that various changes may be made in the form and construction of the parts thereof without departing from the spirit and scope of the invention or sacrificing all of its material advantages, the forms hereinbefore described being merely preferred or exemplary embodiments thereof.

I claim:

1. An article of jewelry, comprising:

a base member having a surface which enables a plurality of studded earrings to be removably supported by said base member in an arrangement determined by the user, said studded earrings being readily removable from said base by hand by the user providing for ready rearrangement of the studded earrings by the user, said base member being randomly penetrable over the entire penetrable surface and capable of supporting said studded earrings in a randomly oriented two dimensional arrangement; and suspension means for allowing the user to wear said article on their person.

2. The article of jewelry of claim 1, wherein said base member is made of a penetrable material through which a holding stud of said studded earrings will extend, and said base member has a sufficient thickness to substantially conceal the length of said holding studs.

3. The article of jewelry of claim 2, wherein said means for wearing the article is a chain loop attached to a side of said base member enabling said article to be worn as a necklace.

4. The article of jewelry of claim 2, wherein said base member is substantially made of cork.

5. The article of jewelry of claim 2, wherein said base member is substantially made of foam material.

6. The article of jewelry of claim 1, further comprising a decorative veil which covers a front surface of the base member.

7. The article of jewelry of claim 6, further comprising a rim, which fits around a perimeter of said base member and secures said decorative veil to said base member.

8. The article of jewelry of claim 7, wherein said rim is removable to allow for interchangeability of decorative veils.

9. The article of jewelry of claim 1, wherein said suspension means is a pin assembly attached to a back surface of said base member.

10. The article of jewelry of claim 1, wherein said studded earrings can be interchanged and displayed on said front surface of said base member in varying arrangements.

11. An article of jewelry, comprising:

a base member made of a penetrable material and having a sufficient thickness to substantially conceal studs of a plurality of pierce earrings supported by said base member;

a decorative veil which provides an interchangeable covering for a front surface of said base member and held in place on said base member by a rim, said rim being removably disposed around a perimeter of said base member; and a pin assembly attached to a back surface of said base member enabling the article to be worn on clothing.

12. An article of jewelry, comprising:

a base member made of a penetrable material and having a sufficient thickness to substantially conceal studs of a plurality of pierced earrings supported by said base member;

a decorative veil which provides an interchangeable covering for a front surface of said base member and held in place on said base member by a rim, said rim being removably disposed around a perimeter of said base member; and a chain loop attached at a point on said perimeter of said base member enabling the article to be worn as a necklace.

13. An article of jewelry, comprising:

a plurality of earrings, each of said earrings having at least one stud protruding therefrom;

a base member made of a randomly penetrable material of a thickness which is sufficient to support the studs of said earrings, said base member having a front surface, a back surface, and a perimeter;

said earrings removably secured to said base member in arrangements determined by the user, said earrings being removably secured over the entire penetrable front surface of said base member by pushing said studs into said penetrable material so that said thickness of said material substantially conceals and frictionally holds said studs, said studded earrings being readily removable from said base by hand by the user providing for ready rearrangement of the studded earrings by the user; and suspension means secured to said base member, said suspension means enabling the user to wear said article on their person.

14. The article of jewelry of claim 13, further comprising a decorative veil secured to said base member and covering said front surface of said base member.

15. The article of jewelry of claim 13, wherein said suspension means is a pin assembly attached to said back surface of said base member.

16. The article of jewelry of claim 13, wherein said suspension means is a chain loop attached to a point on said perimeter of said base member.

* * * * *